US008377283B2

(12) United States Patent
Eckles et al.

(10) Patent No.: US 8,377,283 B2
(45) Date of Patent: Feb. 19, 2013

(54) ZINC AND ZINC-ALLOY ELECTROPLATING

(75) Inventors: William E. Eckles, Cleveland Heights, OH (US); Robert E. Frischauf, Lakewood, OH (US); Frederic Raulin, Witry les Reims (FR); Lionel Thiery, Clichy Gerro (FR); Jean-Jacques Duprat, Drancy (FR)

(73) Assignee: Coventya, Inc., Brooklyn Heights, OH (US)

( * ) Notice: Subject to any disclaimer, the term of this patent is extended or adjusted under 35 U.S.C. 154(b) by 755 days.

(21) Appl. No.: 10/558,959

(22) PCT Filed: Jun. 3, 2003

(86) PCT No.: PCT/US03/17350

§ 371 (c)(1),
(2), (4) Date: Dec. 1, 2005

(87) PCT Pub. No.: WO2004/108995

PCT Pub. Date: Dec. 16, 2004

(65) Prior Publication Data

US 2007/0023280 A1 Feb. 1, 2007

Related U.S. Application Data

(63) Continuation-in-part of application No. 10/296,661, filed on Nov. 25, 2002, now Pat. No. 6,755,960.

(51) Int. Cl.

| | |
|---|---|
| ***C25D 3/22*** | (2006.01) |
| ***C25D 3/56*** | (2006.01) |
| ***C25D 17/10*** | (2006.01) |
| ***C25D 17/00*** | (2006.01) |

(52) U.S. Cl. ..... 205/244; 205/245; 205/246; 205/305; 205/309; 204/252; 204/263; 204/282

(58) Field of Classification Search ..... 204/232; 205/244–246, 305, 309
See application file for complete search history.

(56) References Cited

U.S. PATENT DOCUMENTS

| | | | | |
|---|---|---|---|---|
| 4,778,572 | A | 10/1988 | Brown | |
| 5,112,447 | A | 5/1992 | Gestaut et al. | |
| 5,162,079 | A | 11/1992 | Brown | |
| 5,417,840 | A | 5/1995 | Block et al. | |
| 5,582,709 | A | 12/1996 | Oshima et al. | |
| 5,618,634 | A * | 4/1997 | Hosoda et al. | 428/610 |
| 5,883,762 | A * | 3/1999 | Calhoun et al. | 205/119 |
| 6,602,394 | B1 | 8/2003 | Hillebrand | |
| 6,652,728 | B1 * | 11/2003 | Sonntag et al. | 205/143 |

FOREIGN PATENT DOCUMENTS

| | | |
|---|---|---|
| DE | 198 34 353 A1 | 2/2000 |
| JP | 5-9799 | 1/1993 |
| WO | WO 01/96631 A1 | 12/2001 |

* cited by examiner

*Primary Examiner* — Jonathan Johnson
*Assistant Examiner* — Brian W Cohen
(74) *Attorney, Agent, or Firm* — Tarolli, Sundheim, Covell & Tummino LLP

(57) ABSTRACT

An apparatus (12) for applying a zinc or zinc-alloy electroplate to a workpiece comprises an electroplating bath (16) having a pH more than about 14. The electroplating bath includes zinc ions and an additive. A cathode workpiece (18) is in the bath. An anode assembly (20) contacts the bath. The anode assembly includes an anolyte and an insoluble metal anode in the anolyte. The additive is capable of electrolytically breaking down upon contact with the anode. The anode assembly inhibits the electrolytic breakdown of the additive.

14 Claims, 3 Drawing Sheets

ZINC AND ZINC-ALLOY ELECTROPLATING

RELATED APPLICATION

The present application is a continuation-in-part of U.S. patent application Ser. No. 10/296,661, filed Nov. 25, 2002, (now U.S. Pat. No. 6,755,960), and assigned to the assignee of the present invention. U.S. patent application Ser. No. 10/296,661 filed Nov. 25, 2002, is incorporated herein by reference in its entirety.

FIELD OF THE INVENTION

The present invention relates to an apparatus and process for zinc and zinc alloy electroplating.

BACKGROUND OF THE INVENTION

U.S. Pat. No. 5,162,079 discloses an apparatus for electroplating metals. The apparatus comprises an electroplating bath which contains a plating solution of a metallic salt, for instance, nickel sulfate. A cathode workpiece is positioned in the bath. An insoluble anode assembly is also provided in the bath. The anode assembly includes an anode which is essentially insoluble during electroplating and an anion exchange membrane enclosure around the anode. An electrically conductive acid solution is contained within the enclosure of the anode assembly. The flow of electric current in the apparatus causes anions, for instance sulfate ions, in the plating solution to travel through the anion exchange membrane increasing the acid concentration within the anode assembly enclosure. Accumulated acid is periodically flushed from the enclosure. One purpose of the apparatus of the '079 patent is to inhibit the increase in concentration of dissolved metal in the electroplating bath due to a cathode efficiency which is less than anode efficiency.

U.S. Pat. No. 4,778,572 discloses an apparatus similar to that of the '079 patent. An electroplating apparatus for plating nickel onto a workpiece is provided. A nickel-plating bath is provided in the apparatus. The bath is a typical Watts nickel low pH acid bath. A cathode workpiece is positioned in the bath. An anode structure is also positioned in the bath. The anode structure comprises a series of nickel plate anodes. The nickel plate anodes are enclosed in an ion exchange membrane that allows electric current to flow from the anodes to the cathode workpiece while at the same time shielding the anodes from organics, such as Coumarin within the bath. The nickel plate anodes are immersed in dilute sulfuric acid contained within the ion exchange membrane enclosure.

German Patent Publication DE 19834353A1published Feb. 3, 2000, discloses an apparatus similar to that of the '079 patent for applying, a zinc-nickel coating onto a cathode workpiece. The apparatus comprises a vessel which is divided by a cation exchange membrane into a cathode compartment containing a catholyte and an anode compartment containing an anolyte. The catholyte is an alkaline zinc-nickel electroplating bath containing poly(alkyleneimine) additives for complexing and brightening. A cathode workpiece to be plated is positioned in the cathode compartment. The anolyte is an acid such as sulfuric acid or phosphoric acid. A platinum coated titanium anode is immersed in the anolyte. The ion exchange membrane allows electric current to flow from the anode to the cathode, but at the same time shields the anode from the alkaline zinc-nickel electroplating bath.

Electrolysis of alkaline zinc-nickel baths containing poly (alkyleneimines) produces amine breakdown at the anode into nitrites and cyanides if the anode is exposed to the plating bath. The ion exchange membrane prevents such amine breakdown. However, an apparatus which comprises an alkaline electroplating bath adjacent to an acid anolyte can be dangerous. In addition, a platinum coated titanium anode is expensive.

SUMMARY OF THE INVENTION

The present invention relates to an apparatus for applying a zinc or zinc-alloy electroplate to a workpiece. The apparatus can comprise an electroplating bath having a pH more than about 14. The electroplating bath can include zinc ions and an additive. A cathode workpiece is in the bath. An anode assembly can contact the bath. The anode assembly can include an anolyte and an insoluble metal anode in the anolyte. The additive can be capable of electrolytically breaking down upon contact with the anode. The anode assembly can inhibit the electrolytic breakdown of the additive.

In one aspect, the anode assembly can comprise an enclosure defining an anolyte compartment. At least a portion of the enclosure can be an ion exchange membrane. The anolyte can be disposed in the compartment and the insoluble metal anode can be immersed in the anolyte.

In another aspect, the electroplating bath further comprises additional metal ions, which can be electroplated onto the workpiece with the zinc ions. For example, the additional metal ions can include nickel ions, manganese ions, iron ions, cobalt ions, and combinations thereof. In another aspect, the additional metal ions can be free of nickel ions.

In yet another aspect, the additive can be potentially oxidizable to cyanide upon contact with the anode. The anode can comprise any metal or metalloid that can serve as an anode in a caustic solution. The anolyte can be a sodium or potassium hydroxide solution.

BRIEF DESCRIPTION OF THE DRAWINGS

The present invention and advantages thereof will become more apparent upon consideration of the following specification with reference to the accompanying drawings in which.

DESCRIPTION OF THE EMBODIMENTS

The present invention relates to an electroplating apparatus for applying a zinc or zinc-alloy electroplate to a workpiece. By "zinc-alloy", it is meant a mixture of zinc and at least one other metal, for example, iron, cobalt-iron, and manganese. Other metals not listed in these examples can also be used.

The electroplating apparatus includes an alkaline, cyanide-free, zinc electroplating bath. The electroplating apparatus of the present invention can inhibit the electrolytic breakdown of electroplating bath additives in the electroplating bath.

Figure 1:
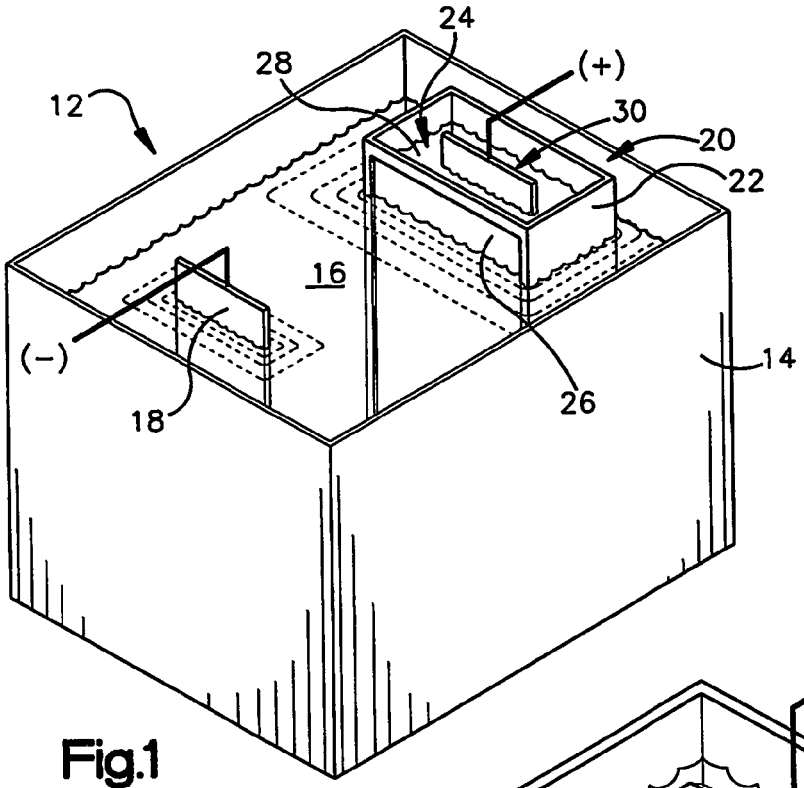
FIG. 1 is a schematic illustration of a zinc-nickel electroplating apparatus in accordance with one aspect of the invention.
Figure 2:
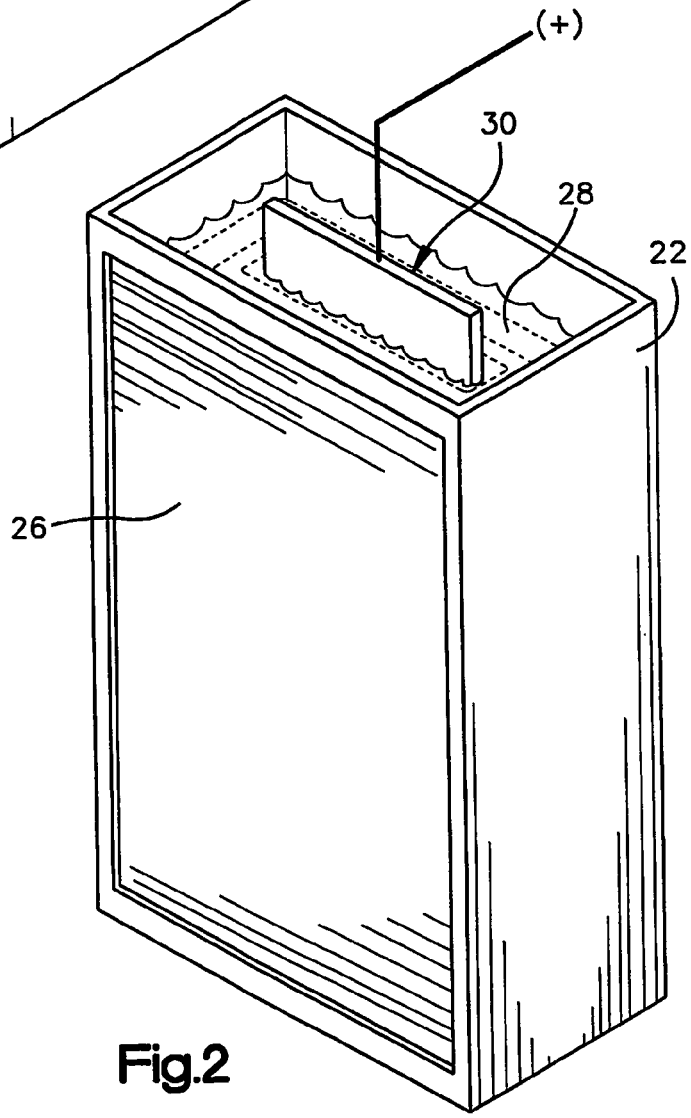
FIG. 2 is a schematic illustration of an anode assembly in the apparatus of FIG. 1 of the invention.

FIG. 1 illustrates an electroplating apparatus in accordance with one aspect of the invention. The electroplating apparatus 12 comprises a tank 14. The tank 14 contains the electroplating bath 16 and a cathode workpiece 18. The tank 14 also comprises an anode assembly 20. Referring to FIG. 2, the anode assembly 20 comprises an enclosure 22, which defines an anolyte compartment 24. The compartment 24 can be closed by the enclosure 22 on all sides and the bottom. At least one wall 26 of the enclosure 22 can be an ion exchange membrane.

The anolyte compartment 24 contains an anolyte 28. An anode 30 can be immersed in the anolyte 28. FIG. 1 shows that the enclosure 22 shields the anode 30 from the electroplating bath 16 so that no bath 16 contacts the anode 30. The ion exchange membrane 26 can face the cathode workpiece 18. This allows electric current to flow from the anode 30 to the cathode workpiece 18 on the application of an electric potential to the anode 30 and the cathode workpiece 18. The electric current flow causes plating of the cathode workpiece 18.

Figure 3:
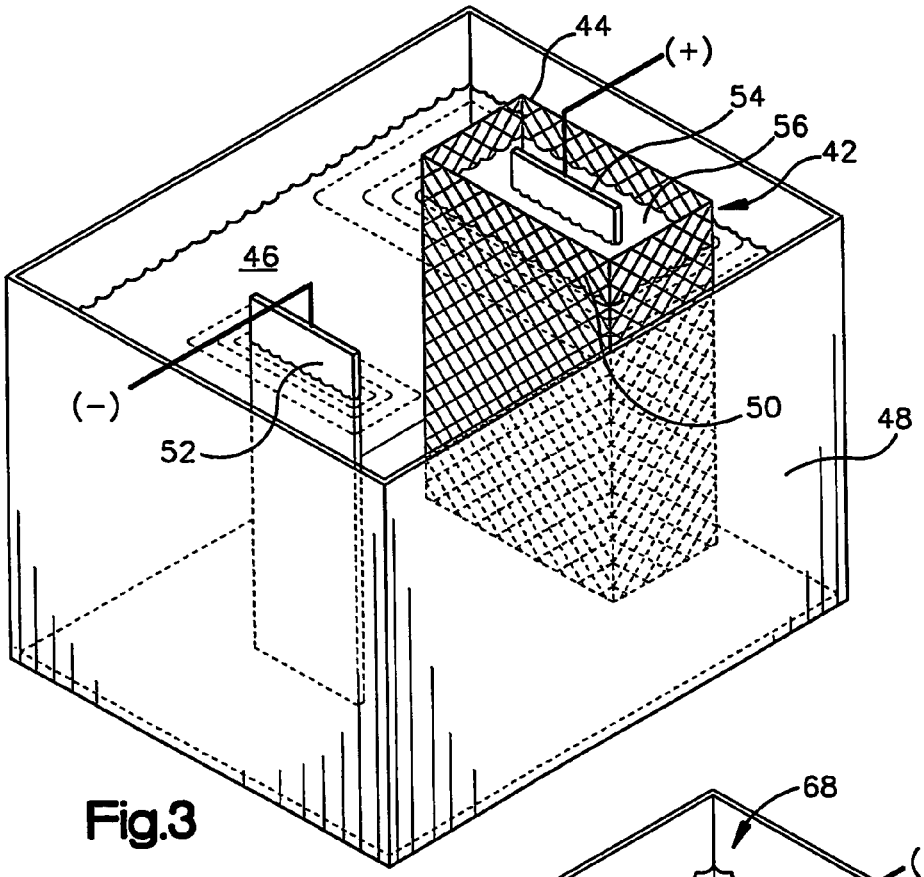
FIG. 3 is a schematic illustration of an anode assembly in accordance with another aspect of the invention.

It will be understood by those skilled in the art that the enclosure 22 and compartment 24 can have many configurations. For example, FIG. 3 shows that an enclosure 42 can comprise a pliable bag 44 that is suspended in a catholyte 46 of a tank 48. At least a portion of the bag 44 and, preferably, substantially all of the bag 44 comprises an ion exchange membrane 50. A cathode workpiece 52 is disposed in the catholyte 46. A metal anode 54 is disposed in the anolyte 56, which is contained within the bag 44.

Figure 4:
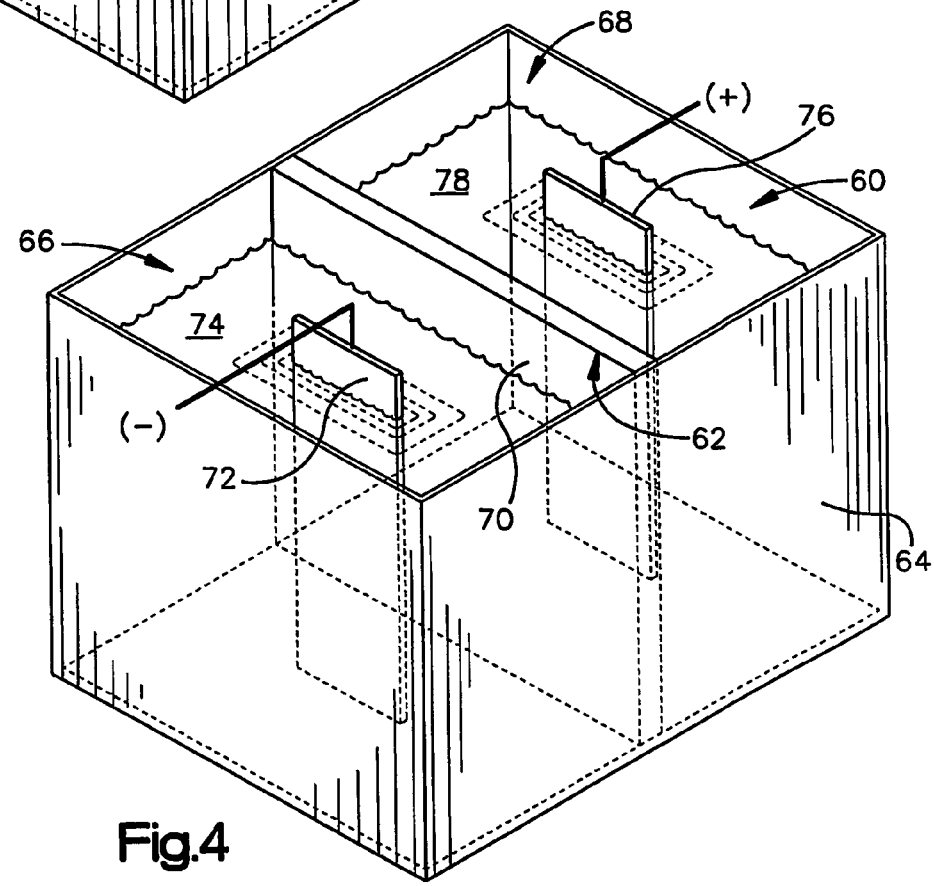
FIG. 4 is a schematic illustration of an anode assembly in accordance with another aspect of the invention.

In yet another aspect of the invention, as shown in FIG. 4, an enclosure 60 can comprise a wall or partition 62 extending cross-wise in a tank 64 dividing the tank 64 into a catholyte compartment 66 and an anolyte compartment 68. At least a portion of the wall 64 and, preferably, substantially all of the wall comprises an ion exchange membrane 70. A cathode workpiece 72 is disposed in the catholyte 74 and a metal anode 76 is disposed in the anolyte 78.

Figure 5:
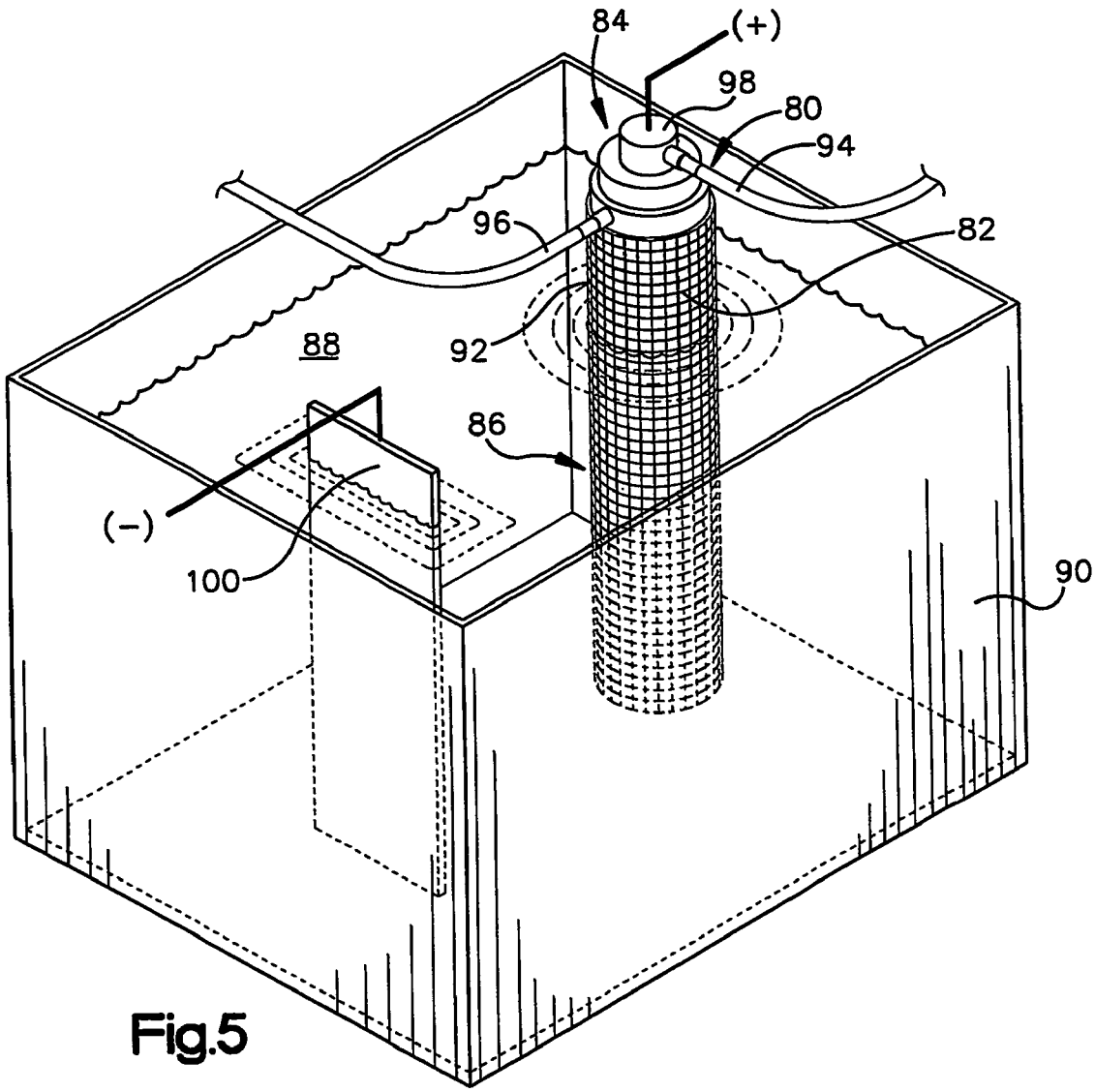
FIG. 5 is a schematic illustration of an anode assembly in accordance with yet another aspect of the invention.

In yet another aspect of the invention, as shown in FIG. 5, an enclosure 80 can comprise a cylindrical member 82. The cylindrical member 82 can have a first end 84 and a second end 86. The second end 86 can be positioned in a catholyte 88 contained within a tank 90. At least a portion of the second end 86, and preferably, substantially all of the second end 86 can comprise an ion exchange membrane 92. The first end 84 can include an anolyte inlet 94 and anolyte outlet 96. The anolyte inlet 94 and anolyte outlet 96 allow anolyte (not shown) to flow into the enclosure 80, about an anode 98 disposed in the enclosure 80, and out of the enclosure. A cathode workpiece 100 is disposed in the catholyte 88.

Other enclosure and compartment configurations that are within the skill of the art can also be used.

In the present invention, the cathode workpiece can be any workpiece typically used in electroplating. In the example of the FIGS. 1 and 2, a steel plate can be used.

The enclosure of the anode assembly can be made of any suitable plastic resistant to the electroplating bath and the anolyte, for instance, polyethylene.

The ion exchange membrane of the enclosure can be any ion exchange membrane used in an electroplating bath, such as a perfluorosulfonic acid ion exchange membrane marketed by E.I. Dupont de Nemours under the trademark NAFION. NAFION is a copolymer of tetrafluorethylene and perfluro-3,6-dioxa-4-methyl-7-octanesulfonic acid. Preferred NAFION membranes used in accordance with the present invention include a NAFION 324 membrane or a NAFION 424 membrane.

Other examples of ion exchange membranes that can also be used include membranes made from sulfonated styrene-divinylbenzene dispersed in a matrix of polyethylene and membranes made by the graft polymerization of the polyethylene and styrene followed by sulfonation.

The anolyte in the anolyte compartment can comprise a conductive salt or base solution, such as an aqueous solution of sodium sulfate or an alkaline solution of potassium hydroxide or sodium hydroxide. These alkaline solutions can have concentrations, by way of example, in the range of one molar to about 20 molar hydroxide, with a preferred concentration range of 1 to 10 molar hydroxide. A preferred anolyte can comprise about 50 g/liter sodium hydroxide to about 760 g/liter sodium hydroxide.

The anode of the anode assembly can comprise a metal or metalloid that is capable of functioning as an anode in an electroplating bath and that is stable in a caustic solution. By "stable in a caustic solution", it is meant that the anode does not decompose, deteriorate, or erode in a caustic solution. Examples of metals that can be used include nickel, cobalt, iron, chromium, and alloys thereof, such as steel and ferrous alloys. Other metals or metalloids can also be used as long as they are capable of functioning as an anode and are stable in a caustic solution.

The anode can be a solid metal or metalloid or a metal coated on a substrate. For instance, the anode can be nickel, a nickel alloy, or nickel coated onto a substrate. The substrate can be metal, such as steel, copper or aluminum or a plastic. An example of a nickel alloy is Hastelloy, which is 55% nickel and 45% chromium. The nickel or nickel alloy can be electroplated onto a substrate using a Watts type plating bath, or using an electroless nickel or nickel alloy plating process. Similarly, the anode can be cobalt or cobalt coated onto a substrate, and alloys thereof. The anode can also be a mild steel, a steel alloy, ferrous alloy, or an iron chromium alloy, such as stainless steel.

The material construction of the anode is not restricted. For example, either an electrolytic coating or an electroless coating can be effectively employed on the anode. Practical considerations, such as cost and stability in a caustic solution will dictate the most suitable material for the anode.

The electroplating bath can be an aqueous solution that is alkaline, having a pH that is preferably about 14. The bath contains an inorganic alkaline component in an amount effective to achieve this pH. Based on the electroplating bath of the alkaline component, amounts from about 50 g/liter to about 200 g/liter, can be used. Examples of suitable alkaline components are alkali metal derivatives, such as sodium hydroxide, potassium hydroxide, sodium carbonate and potassium carbonate.

The electroplating bath can also contain a controlled amount of zinc ions. The source for the zinc ions for the electroplating bath can be any zinc compound, which is soluble in an alkaline aqueous medium. Examples of zinc compounds which can be added to the electroplating bath are zinc oxide or a soluble zinc salt, such as zinc sulfate, zinc carbonate, zinc sulfamate, and zinc acetate. The concentration of zinc ions in the electroplating bath can be from about 1 to 100 g/liter (about 1,000 ppm to about 100,000 ppm), preferably about 4 to about 50 g/liter (about 4,000 to about 50,000 ppm). At a pH about 14, the predominant zinc species in the bath is zincate ion.

The bath can further contain a controlled amount additional metal ions, which are not zinc ions. In accordance with one aspect of the invention, these additional metal ions can include any metal ion that can be effectively electroplated with the zinc ions onto the workpiece in an alkaline electroplating bath. Examples of these metal ions can include transition metal ions, such as nickel ions, manganese ions, iron ions, cobalt ions, and combinations thereof. Other metal ions not listed, which can be electroplated with the zinc ions onto the workpiece in an alkaline electroplating bath, can also be used and are within the scope of the present invention.

In accordance with another aspect of the invention, the additional metal ions can comprise only nickel ions. The source for the nickel ions for the electroplating bath can be any nickel compound, which can be made soluble in an aqueous alkaline solution. Examples of suitable nickel compounds are inorganic and organic acid salts of nickel, such as nickel sulfate, nickel carbonate, nickel acetate, nickel sulfamate, and nickel formate. The concentration of nickel ions in the electroplating bath can be from about 0.1 to about 10 g/liter (about 100 to 10,000 ppm), more preferably in the range from about 0.1 gram per liter to about 3 g/liter (about 100 ppm to about 3,000 ppm).

In accordance with yet another aspect of the invention, the additional metal ions can include any metal ion except that nickel ions cannot be used as the sole additional metal ions. In this aspect, the electroplating bath can comprise, for example, a mixture of zinc ions and iron ions, a mixture of zinc ions, nickel ions, and iron ions, but not a mixture of zinc ions and nickel ions. The source for these additional metal ions for the electroplating bath can be any suitable metal compound, which can be made soluble in an aqueous alkaline solution. The concentration of metal ions in the electroplating bath can be from about 0.1 to about 10 g/liter (about 100 to 10,000 ppm), more preferably in the range from about 0.1 g/liter to about 3 g/liter (about 100 ppm to about 3,000 ppm).

The electroplating bath can also contain, in addition to the zinc and the additional metal ions, at least one additive commonly used in a zinc or zinc alloy electroplating bath that improves an aspect of the electroplating process. Examples of aspects of the electroplating process that can be improved include the physical properties of the electroplate and the metal complexing properties of the bath.

The additive can be any type of additive, which is potentially capable of electrolytically breaking down at the anode (i.e., reacting at the anode) to produce a breakdown product (i.e., a reaction product), which would detrimentally affect the electroplating process. These breakdown products can detrimentally affect the electroplating process by, for example, inhibiting the plating rates, producing a dull deposit, increasing the toxicity of the electroplating bath, precipitating from solution insoluble breakdown products.

Although the additives in accordance with the present invention can potentially electrolytically breakdown upon contact with an anode, the additives when used with the anode assembly of the present invention do not undergo electrolytic breakdown. The anode assembly of the present invention inhibits electrolytic breakdown by minimizing contact of the additives with the anode.

One type of additive, which is capable of potentially electrolytically breaking down at the anode, can comprise an amine. Amines can potentially be oxidizable to cyanides upon contact with the anode. Examples of amines that are oxidizable to cyanides include alphatic amines, such as ethyleneimine, 1,2-propyleneimine, 1,2-butyleneimine, and 1,1-dimethylethyleneimine as well as polyamines, such as poly (alkyleneimine).

The poly(alkyleneimines) may have molecular weights from about 100 to about 100,000 and should be soluble in the bath. By way of example, poly(ethyleneimine) which is useful in the bath can have a molecular weight of from about 150 to above about 2,000. Useful poly(ethyleneimines) are available commercially, for example from BASF under the designation LUGALVAN G-15, LUGALVAN G-20, and LUGALVAN G-35. Examples of other useful poly(alkyleneimines) are tetraethylenepentamine (TEPA), pentaethylenehexamine (PEHA), and heptaethylene octamine marketed by Nippon Shokubai Co. Ltd. under the trademark EPOMIN 003. One function of the aliphatic poly(alkyleneimines) is to complex metal ions in the alkaline zinc bath.

Another type of additive, which is capable of potentially electrolytically breaking down at the anode, is the reaction product of imidazole and an electrophylic difunctional monomer, such as epichlorohydrin. These polymers can break down to produce cyanide at levels of about 3 ppm. While this is not a very high amount of cyanide, the cost of treatment of the electroplating bath can increase many times because of the presence of cyanide even at trace levels.

Yet another type of additive, which is capable of potentially electrolytically breaking down at the anode, is polyquaternium-2. Polyquaternium-2 upon contact with the anode can breakdown causing slow plating rates and dull deposits. In certain cases, these effects become so severe that the bath must be dumped after as little as six months.

Still yet another type of additive, which is capable of potentially electrolytically breaking down at the anode, is a chelating agent, such as gluconate or tartrate. These additives can be oxidized at the anode to produce oxalate.

It will be understood by those skilled in the art that the electroplating bath may also contain other additives such as other brighteners, and metal complexing agents, which may or may not electrolytically breakdown upon contact with the anode. One useful metal complexing agent is QUADROL from BASF. QUADROL is N,N,N',N'-tetrakis(2-hydroxypropyl)-ethylenediamine.

The present invention is further illustrated by the following examples. These examples show the advantages of using membrane anode enclosures in alkaline zinc and zinc-alloy plating baths. These examples are provided for illustration and are not to be construed as limiting the scope or content of the invention in any way.

EXAMPLE 1

An alkaline zinc-nickel bath contained 10 g/liter of zinc, 1.5 g/liter of nickel, 20 g/liter of tetraethylenepentamine (TEPA) and 10 g/liter QUADROL. An anode box (disclosed in FIG. 1) having a NAFION 450 membrane on one side, containing 500 mL of a solution of 150 g of sodium hydroxide was placed in a zinc-nickel bath. A metal anode was placed in the anode box. The metal anode was made of a coating of electroless nickel (containing 10% P) on steel. 5 amperes of current were passed through the cell for 6 hours. The plating bath was analyzed for cyanide, and no cyanide was detected. There was no erosion of the electroless coated steel anode in the anode box.

EXAMPLE 2

In this Example, the anode box was filled with a solution of 150 g/liter of sodium hydroxide in water. The metal anode in the box was made of nickel metal. A cell, similar to Example 1, was run at 5 amperes for 6 hours as before. The plating bath was analyzed for cyanide, and no cyanide was detected. The nickel anode had a thin conductive coating of nickel oxide/nickel hydroxide, which did not interfere with the plating process. There was no weight loss of nickel anode.

EXAMPLE 3

The anode box of Example 1 was filled with a 20% solution of 50% liquid caustic. The metal anode was nickel electroplated from a Watts type plating solution, onto a steel base metal. The bath was run at 5 amperes and 6.84 volts for 6 hours. The plating bath was analyzed for cyanide, and no cyanide was detected. There was no metal anode weight loss.

EXAMPLE 4

A zinc-nickel plating bath, similar to the bath in Example 1, was electrolyzed for 100 ampere hours, using a box anode with a NAFION 450 ion exchange membrane covering one side of the box. The anode in the box was steel coated with electroless nickel that contained 8% P. After 100 amperes hours, the bath was analyzed for cyanide and was found to contain no detectable cyanide. There was no metal anode weight loss.

COMPARATIVE EXAMPLE 5

A 2-liter alkaline zinc-nickel plating bath containing 30 g/liter of polyethyleneimine (TEPA) was electrolyzed for 160 ampere-hours with a nickel anode placed directly into the plating bath. The bath was found to contain 508 ppm of cyanide.

EXAMPLE 6

The anode box of Example 1 was filled with a solution of 150 g/liter of potassium hydroxide. The metal anode in the anolyte was mild steel Q-panel. The bath, which was similar to the bath of Example 1, was electrolyzed at 5 amperes for 6 hours. There was a slight loss of weight from the steel anode. The electrolyte was analyzed for cyanide, and no cyanide was detected.

EXAMPLE 7

The anode box of Example 1 is filled with a solution of 150 g/liter of sodium hydroxide. The metal anode in the box is cobalt. The alkaline zinc-nickel bath contains 20 g/liter of poly(ethyleneimine) and is electrolyzed for 30 ampere-hours.

EXAMPLE 8

The metal anode in the anode box of Example 1 is steel coated with cobalt. The plating bath is similar to Example 1. The anolyte in the box is a 20% solution of 50% liquid caustic.

EXAMPLE 9

In this Example, the metal anode in the anode box is a cobalt alloy anode. The anolyte is a 20% solution of 50% liquid caustic. The plating bath and apparatus are similar to Example 1.

EXAMPLE 10

In this Example, the metal anode is steel coated with a cobalt alloy coating from an electroless, cobalt plating bath. The zinc-nickel plating bath and apparatus are similar to Example 1. The anode box contains a 15% solution of 50% liquid caustic. The alkaline zinc-nickel bath is electrolyzed for 6 hours at 5.0 amperes.

EXAMPLE 11

In this Example, the metal anode in the anode box was stainless steel. The plating bath and apparatus were similar to Example 1. After 30 ampere-hours, there was no detectable cyanide. There was no weight loss from the stainless steel anode.

EXAMPLE 12

An alkaline non-cyanide zinc plating bath was prepared containing 10 g/liter of zinc, 130 g/liter of sodium hydroxide, 8 ml/liter of a brightener and about 5 g/liter of sodium tartrate. After extended periods of electrolysis, a white precipitate formed in the plating bath. This precipitate was sodium oxalate, produced by anodic oxidation. The precipitated oxalate interfered with the brighteners, causing dull and rough zinc plate.

The use of an anode enclosure with an electroless nickel coated steel anode, prevented the oxidation of tartrate to oxalate, thus eliminating the interference with the brighteners and the roughness caused by precipitated oxalate.

EXAMPLE 13

A zinc-iron alloy bath containing 20 g/liter of zinc, 300 ppm of iron, 130 g/liter of sodium hydroxide and 50 g/liter of triethanolamine (TEA) to complex the iron, was electrolyzed for an extended period of time. The anodic oxidation of the TEA produced breakdown products, which interfered with waste treatment.

The use of an anode enclosure, with a pure nickel anode, prevented the oxidation of TEA.

EXAMPLE 14

Two test cells containing alkaline zinc-nickel plating baths were electrolyzed for 40 ampere-hours. One cell had a nickel anode without an anode enclosure and the other cell had an anode enclosure containing a nickel anode. The electrolyte in each cell was composed of 10 g/liter of zinc, 1,500 ppm of nickel, 25 g/liter of tetraethylenepentamine, and a brightener. The membrane anode enclosure contained 1 liter of a 25% solution of 50% liquid caustic in water.

After 40 ampere-hours, the cell with the direct anode was plating with 6.5% lower efficiency than the cell with the membrane enclosed anode. After two months of continuous operation, the cell with the direct anode was plating with about 40% lower efficiency than the cell with the membrane enclosed anode.

EXAMPLE 15

An alkaline zinc plating bath, containing 10 g/liter of zinc, 130 g/liter of sodium hydroxide and maintained with 2 g/liter of Mirapol WT, was operated until the anodic breakdown products from the anodic oxidation of the Mirapol reduced the cathodic efficiency by about 50% of the initial level of efficiency, which took about 1 year. Using membrane enclosed anodes eliminates this decrease in cathodic efficiency, because the Mirapol WT is prevented from undergoing anodic oxidation.

As illustrated by the above examples and in accordance with the present invention, an apparatus and process are provided by which zinc and a zinc-alloy can be safely plated onto a substrate using an electroplating bath containing an additive, especially poly(alkyleneimines). This is accomplished without anode corrosion or generating cyanides in the electroplating bath.

It will be understood by those skilled in the art that a commercial apparatus and process will employ a electroplating bath comprising additives in addition to additives described in above. In addition, a commercial bath typically can employ a 4000 liter tank and the cathode workpiece can be positioned between arrays of compartmentalized anodes on opposite sides of the cathode along the sides of the tank.

From the above description of the invention, those skilled in the art will perceive improvements, changes and modifications. Such improvements, changes and modifications within the skill of the art are intended to be covered by the appended claims.

Having described the invention the following is claimed:

1. An apparatus for applying a zinc or zinc-alloy electroplate to a workpiece, said apparatus comprising:

an electroplating bath having a pH of about 14, said electroplating bath including zinc ions and an additive;

a cathode workpiece in said bath;

an anode assembly contacting said bath, said anode assembly including an anolyte and an insoluble metal anode in said anolyte, said anolyte comprising a conductive salt or base solution;

said additive being capable of electrolytically breaking down and oxidizable to cyanide upon contact with said anode;

said anode assembly inhibiting the electrolytic breakdown of said additive, the electroplating bath containing no detectable cyanide after applying a zinc or zinc-alloy electroplate to the workpiece.

2. The apparatus of claim 1 wherein the anode assembly comprises an enclosure defining an anolyte compartment, at least a portion of the enclosure being an ion exchange membrane, said anolyte being disposed in said anolyte compartment, and said insoluble metal anode being immersed in said anolyte.

3. The apparatus of claim 2 wherein said enclosure comprises a bag, said bag being disposed in said electroplating bath, at least a portion of said bag being an ion exchange membrane.

4. The apparatus of claim 2 wherein said enclosure comprises a wall, said wall dividing a tank into a first compartment and second compartment, at least a portion of said wall being an ion exchange membrane.

5. The apparatus of claim 2 wherein said enclosure comprises a member, said member including a first end and a second end, said second end being disposed in said electroplating bath, said first end including an anolyte inlet and anolyte outlet, said anolyte inlet and said anolyte outlet allowing anolyte to flow through said enclosure.

6. The apparatus of claim 1 wherein the electroplating bath further comprises additional metal ions, which can be electroplated onto said workpiece with the zinc ions.

7. The apparatus of claim 6 wherein the additional metal ions are selected from the group consisting of nickel ions, manganese ions, iron ions, cobalt ions, and combinations thereof.

8. The apparatus of claim 7 wherein the electroplating bath is free of nickel ions.

9. The apparatus of claim 5 wherein said anode comprises nickel, a nickel alloy, a nickel coating, a nickel alloy coating, cobalt, a cobalt alloy, a cobalt coating, a cobalt alloy coating, mild steel, a steel alloy, or a ferrous alloy, and said anolyte is a sodium or potassium hydroxide solution comprising 50 to about 760 grams per liter sodium or potassium hydroxide.

10. An apparatus for applying a zinc or zinc-alloy electroplate to a workpiece comprising:

an electroplating bath having a pH of about 14, said electroplating bath including zinc ions and an additive;

a cathode workpiece in said bath;

an anode assembly contacting said bath, said anode assembly including an enclosure defining an anolyte compartment, at least a portion of the anode assembly being an ion exchange membrane, an anolyte in said compartment, and an insoluble metal anode in said anolyte;

said anolyte comprising a conductive salt or base solution, said additive being capable of electrolytically breaking down and oxidizable to cyanide upon contact with said anode, the electroplating bath containing no detectable cyanide after applying a zinc or zinc-alloy electroplate to the workplace.

11. The apparatus of claim 10 wherein the electroplating bath further comprises additional metal ions which can be electroplated onto said work piece with the zinc ions.

12. The apparatus of claim 11 wherein the additional metal ions are selected from the group consisting of nickel ions, manganese ions, iron ions, cobalt ions, and combinations thereof.

13. The apparatus of claim 12 wherein the electroplating bath is free of nickel ions.

14. The apparatus of claim 10 wherein said anode comprises nickel, a nickel alloy, a nickel coating, a nickel alloy coating, cobalt, a cobalt alloy, a cobalt coating, a cobalt alloy coating, mild steel, a steel alloy, or a ferrous alloy, and said anolyte is a sodium or potassium hydroxide solution comprising 50 to about 760 grams per liter sodium or potassium hydroxide.

* * * * *